US006676385B1

(12) United States Patent
Choroszylow et al.

(10) Patent No.: US 6,676,385 B1
(45) **Date of Patent: *Jan. 13, 2004**

(54) COMPRESSOR ASSEMBLY

(76) Inventors: Ewan Choroszylow, 125 Church St., East Aurora, NY (US) 14052; Giovanni Aquino, 29 Byron Ave., Kenmore, NY (US) 14223; Howard J. Greenwald, 111 Hickory Ridge Rd., Rochester, NY (US) 14625

( * ) Notice: Subject to any disclaimer, the term of this patent is extended or adjusted under 35 U.S.C. 154(b) by 0 days.

This patent is subject to a terminal disclaimer.

(21) Appl. No.: 10/010,267

(22) Filed: Dec. 6, 2001

Related U.S. Application Data

(63) Continuation-in-part of application No. 09/977,002, filed on Oct. 12, 2001, which is a continuation-in-part of application No. 09/536,332, filed on Mar. 24, 2000, now Pat. No. 6,266,952, which is a continuation-in-part of application No. 09/416,291, filed on Oct. 14, 1999, now Pat. No. 6,499,301, which is a continuation-in-part of application No. 09/396,034, filed on Sep. 15, 1999, now Pat. No. 6,301,898, which is a continuation-in-part of application No. 09/181,307, filed on Oct. 28, 1998, now abandoned.

(51) Int. Cl.[7] ..... F04B 53/00

(52) U.S. Cl. ..... 417/313; 418/61.2; 418/116; 418/225

(58) Field of Search ..... 417/313; 418/61.2, 418/113, 116, 225

(56) References Cited

U.S. PATENT DOCUMENTS 5,431,551 A 7/1995 Aquino et al.
6,301,898 B1 10/2001 Choroszylow et al.

*Primary Examiner*—Justine R. Yu
*Assistant Examiner*—John F. Belena
(74) *Attorney, Agent, or Firm*—Howard J. Greenwald

(57) ABSTRACT

A rotary device containing a housing having a curved inner surface with a profile equidistant form a trochoidal curve, an eccentric mounted on a shaft disposed within the housing, a rotor mounted on the eccentric shaft which contains at least three sides, a partial bore located at the intersection of adjacent sides, and at least three rollers rotatably mounted within the partial bores of the roller. The rotor is comprised of a front face, a back face, a first side, a second side, and a third side. On each front and back face, between adjacent sides, an opening is formed. The openings are on opposing front and back faces are offset from a centerline of the rotary device.

18 Claims, 9 Drawing Sheets

COMPRESSOR ASSEMBLY

CROSS-REFERENCE TO RELATED PATENT APPLICATIONS

This application is a continuation-in-part of applicants' patent application U.S. Ser. No. 09/977,002, filed on Oct. 12, 2001, which was a continuation-in-part of patent application U.S. Ser. No. 09/536,332, filed on Mar. 24, 2000 now U.S. Pat. No. 6,266,952, which was a continuation-in-part of U.S. Ser. No. 09/416,291, filed on Oct. 14, 1999 now U.S. Pat. No. 6,499,301, which was a continuation-in-part of U.S. Ser. No. 09/396,034, filed on Sep. 15, 1999 now U.S. Pat. No. 6,301,898, which in turn was a continuation-in-part of patent application U.S. Ser. No. 09/181,307, filed on Oct. 28, 1998 now abandoned.

FIELD OF THE INVENTION

A rotary device containing a housing having a curved inner surface with a profile equidistant from a trochoidal curve, an eccentric mounted on a shaft disposed within the housing, a rotor mounted on the eccentric shaft which contains at least three faces, a partial bore located at the intersection of adjacent faces, and at least three rollers rotatably mounted within the partial bores of the roller. The rotor is comprised of a front face, a back face, a first side, a second side, and a third side. On each front and back face, between adjacent sides, an opening is formed.

BACKGROUND OF THE INVENTION

In applicants' U.S. Pat. No. 5,1131,551, there is disclosed and claimed a rotary device comprised of a housing comprising a curved inner surface with a profile equidistant form a trochoidal curve, an eccentric mounted on a shaft disposed within said first housing, a first rotor mounted on said eccentric shaft which is comprised of a first side, a second side, and a third side, a first partial bore disposed at die intersection of said first side and said second side, a second partial bore disposed at the intersection of said second side and said third side, a third partial bore disposed at the intersection of said third side and said first side, a first solid roller disposed fluid rotatably mounted within said first solid bore, a second solid roller disposed and rotatably mounted within said second partial bore, and a third solid roller disposed and rotatably mounted within said third pairtial bore. The rotor is comprised of a front face, a back face, a first side, a second side, and a third side, wherein a first opening is formed between and communicates between said front face and said first side, a second opening is formed between and communicates between said back face and said first side, wherein each of said first opening and said second opening is substantially equidistant and symmetrical between said first partial bore and said second partial bore, a third opening is formed between and communicates between said front face and said second side, a fourth opening is formed between and communicates between said back face and said second side, wherein each of said third opening and said fourth opening is substantially equidistant and symmetrical between said second partial bore and said third partial bore, a fifth opening is formed between and communicates between said front face and said third side, and a sixth opening is formed between and communicates between said back face and said third side, wherein each of said fifth opening and said sixth opening is substantially equidistant and symmetrical between said third partial bore and said first partial bore. Each of said first partial bore, said second partial bore, and said third partial bore is comprised of a centerpoint which, as said rotary device rotates, moves along said trochoidal curve. Each of said first opening, said second opening, said third opening, said fourth opening, said fifth opening, and said sixth opening has a substantially U-shaped cross-sectional shape defined by a first linear side, a second linear side, and an arcuate section joining said first linear side and said second linear side, wherein said first linear side and said second linear side are disposed with respect to each other at an angle of less than ninety degrees, and said substantially U-shaped cross-sectional shape has a depth which is at least equal to its width. The diameter of said first solid roller is equal to the diameter of said second solid roller, and the diameter of said second solid roller is equal to the diameter of said third solid roller. The widths of each of said first opening said second opening, said third opening, said fourth opening, said fifth opening, and said sixth opening are substantially the same, and the width of each of said openings is less than the diameter of said first solid roller. Each of said first side, said second side, and said third side has substantially the same geometry and size and is a composite shape comprised of a first section and a second section, wherein said first section has a shape which is different from said second section.

A similar patent, U.S. Pat. No. 6,301,898, issued to applicants' on Oct. 16, 2001. This patent discloses and claims a rotary device comprised of a housing comprising a curved inner surface with a profile equidistant from a trochoidal curve, an eccentric mounted on a shalt disposed within said housing, a first rotor mounted on said ecceitric which is comprised of a first side, a second side, and a third side, a first partial bore disposed at the intersection of said first side and said second side, a second partial bore disposed at the intersection of said second side and said third side, a third partial bore disposed at the intersection of said third side and said first side, a first hollow roller disposed and rotatably mounted within said first solid bore, a second hollow roller disposed and rotatably mounted within said second partial bore, and a third hollow roller disposed and rotatably mounted within said third partial bore, wherein: (a) said rotor is comprised of a front face, said back face, said first side, said second side, and said third side, wherein: 1. a first opening is formed between and communicates between said front face and said first side, 2. a second opening is formed between and communicates between said back face and said first side, wherein each of said first opening and said second opening is substantially equidistant and symmetrical between said first partial bore and said second partial bore, 3. a third opening is formed between and communicates between said front face and said second side, 4. a fourth opening is formed between and communicates between said back face and said second side, wherein each of said third opening and said fourth opening is substantially equidistant and symmetrical between said second partial bore and said third partial bore, 5. fifth opening is formed between and communicates between said front face and said third side, and 6. a sixth opening is formed between and communicates between said back face and said third side, wherein each of said fifth opening and said sixth opening is substantially equidistant and symmetrical between said third partial bore and said first partial bore; (b) each of said first partial bore, said second partial bore, and said third partial bore is comprised of a centerpoint which, as said rotary device rotates, moves along said trochoidal curve; (c) each of said first opening, said second opening, said third opening, said fourth opening, said fifth opening, and said sixth opening has a substantially U-shaped crosssectional shape defined by a first linear side, a second linear side, and an arcuate section joining said first linear side and said second linear side, wherein: 1. said first linear side and said second linear side are disposed with respect to each other at an angle of less than ninety degrees, and 2. said substantially U-shaped cross-sectional shape has a depth which is at least equal to its width; (d) the diameter of said first hollow roller is equal to the diameter of said second hollow roller, and the diameter of said second hollow roller is equal to the diameter of said third hollow roller; (e) the widths of each of said first opening said second opening, said third opening, said fourth opening, said fifth opening, and said sixth opening arc substantially the same, and the width of each of said openings is less than the diameter of said first hollow roller; and (f) each of said first side, said second side, and said third side has substantially the same geometry and size and is a composite shape comprised of a first section and a second section, wherein said first section has a shape which is different from said second section. The entire disclosure of each of U.S. Pat. Nos. 5,431,551 and 6,301,898 is hereby incorporated by reference into this specification.

The compressors of U.S. Pat. Nos. 5,431,551 and 6,301,898, although substantial better than prior art compressors, exhibited dynamic losses in the port areas due to restricted flow areas. It is an object of this invention to provide a compressor which has lower port losses.

SUMMARY OF THE INVENTION

In accordance with this invention, there is provided a rotary positive displacement compressor assembly comprising a housing having a curved inner surface with a profile equidistant from a trochoidal curve, and eccentric mounted on a shaft disposed within said housing, a rotor mounted on said eccentric shaft which is comprised of a bore with an axial centerline, a front face, a back face, a first side, a second side, and a third side, a first partial bore disposed at the intersection of the first side and the second side, a second partial bore disposed at the intersection of said second side and said third side, a third partial bore disposed at the intersection of said third side and said first side, a first roller disposed and rotatably mounted within said first partial bore, a second roller disposed and rotatably mounted within said second partial bore and a third roller disposed and rotatably mounted within said third partial bore. In this assembly, a first opening is formed between and communicates between said front face and said first side, a second opening is formed between and communicates between said back face and said first side, a third opening is formed between and communicates between said front face and said second side, a fourth opening is formed between and communicates between said back face and said second side, a fifth opening is formed between and communicates between said front face and said third side, and a sixth opening is formed between and communicates between said back face and said third side. In the assembly, a first transverse rotor centerline extends through said first side, a second transverse rotor centerline extends though said second side, and a third transverse rotor centerline extends through said third side, provided that each of said first transverse rotor centerline, said second transverse rotor centerline, and said third transverse rotor centerline also extends through said axial centerline of said bore in said rotor. The first opening is comprised of a first opening centerline, said second opening is comprised of a second opening centerline, provided that said first opening centerline and said second opening centerline are each offset from said rotor transverse centerline by at least 0.1 inches and from about 0.x to about 4.x, wherein x is equal to the width of said opening. The third opening is comprised of a third opening centerline, said fourth opening is comprised of a fourth opening centerline, provided that said third opening centerline and said fourth opening centerline are each offset from said rotor transverse centerline by at least 0.1 inches and from about 0.x to about 4.x, wherein x is equal to the width of said opening. The fifth opening is comprised of a first opening centerline, said sixth opening is comprised of a second sixth centerline, provided that said fifth opening centerline and said sixth opening centerline are each offset from said rotor transverse centerline by at least 0.1 inches and from about 0.x to about 4.x, wherein x is equal to the width of said opening. In the assembly, the degree to which said first opening centerline, said third opening centerline, and said fifth opening centerline are offset from said rotor transverse centerlines are the same; and the degree to which said second opening centerline, said fourth opening centerline, and said sixth opening centerline are offset from said rotor transverse centerlines are the same.

BRIEF DESCRIPTION OF THE DRAWINGS

The claimed invention will be described by reference to the specification and the following drawings, in which:

DESCRIPTION OF THE PREFERRED EMBODIMENTS

In the first part of this specification, and by reference to FIGS. 1, 2, 3, 4, 4A, 5, 6, 7, and 8, 9, 10, and 11, a first guide rotor compressor will be described. Thereafter, in the second part of this specification, a second guided rotor compressor will be described.

FIGS. 1, 2, 3, 4, 4A, 5, 6, 7, and 8 are identical to the FIGS. 1, 2, 3, 4, 4A, 5, 6, 7, and 8 appearing in U.S. Pat. No.

5,431,551; and they are presented in this case to illustrate the similarities and differences between the rotary positive displacement device of such patent and the rotary positive displacement device of one embodiment of the instant application. The entire disclosure, the drawings, the claims, and the abstract of U.S. Pat. No. 5,431,551 are hereby incorporated by reference into this specification.

Figure 1:
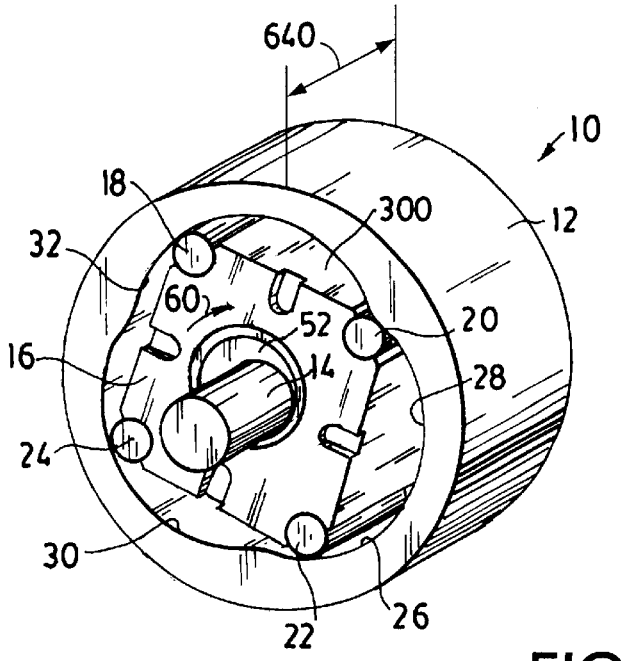
FIG. 1 PRIOR ART
FIG. 1 is a perspective view of one preferred rotary mechanism claimed in U.S. Pat. No. 5,431,551.
Figure 2:
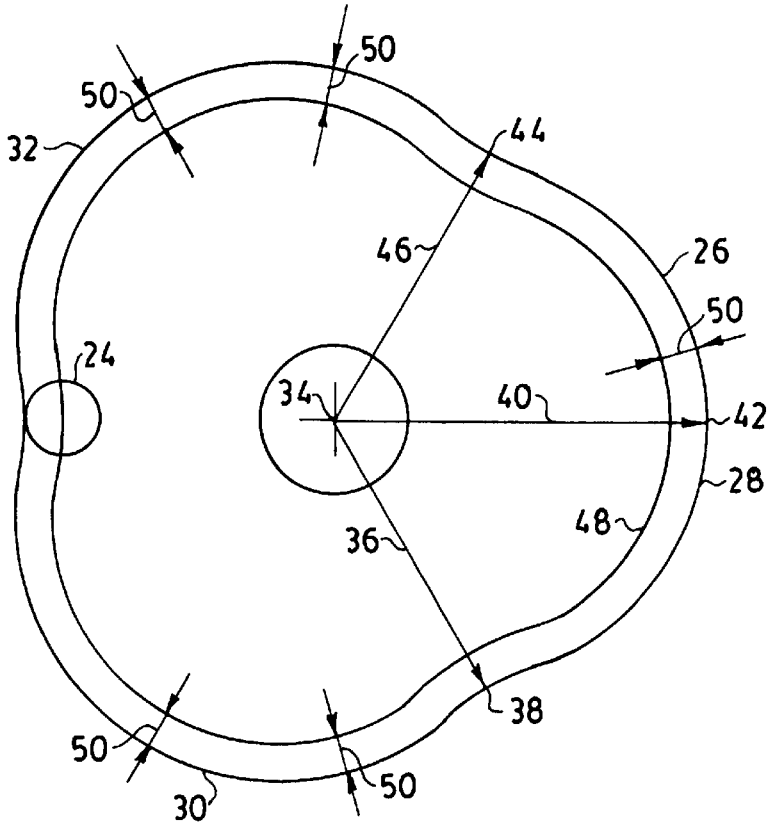
FIG. 2 PRIOR ART
FIG. 2 is an axial, cross-sectional view of the mechanism of FIG. 1.
Figure 3:
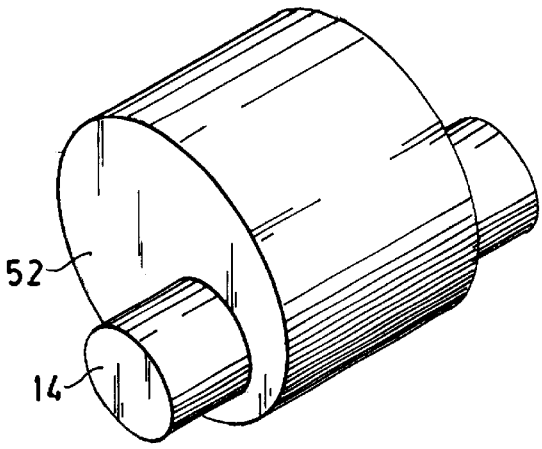
FIG. 3 PRIOR ART
FIG. 3 is a perspective view of the eccentric crank of the mechanism of FIG. 1.
Figure 4:
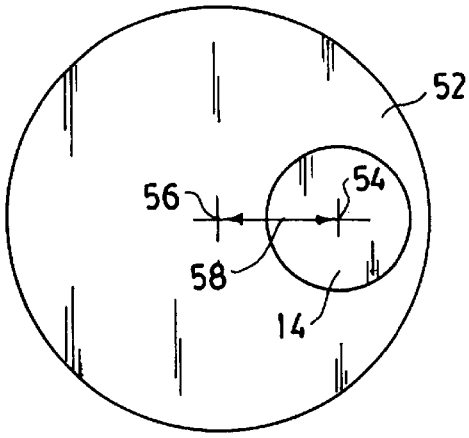
FIG. 4 PRIOR ART
FIG. 4A is a transverse, cross-sectional view of the eccentric crank of FIG. 3.
Figure 4A:
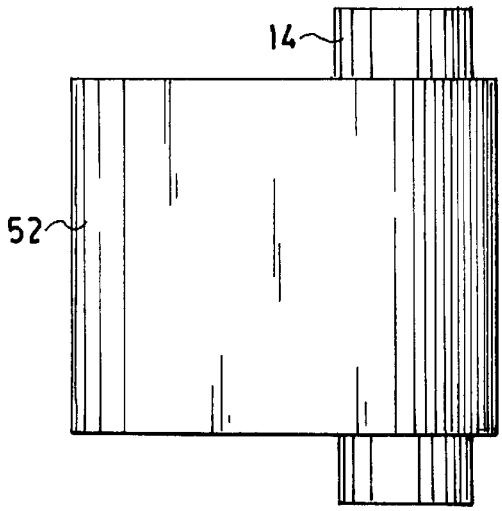
FIG. 4A PRIOR ART
Figure 5:
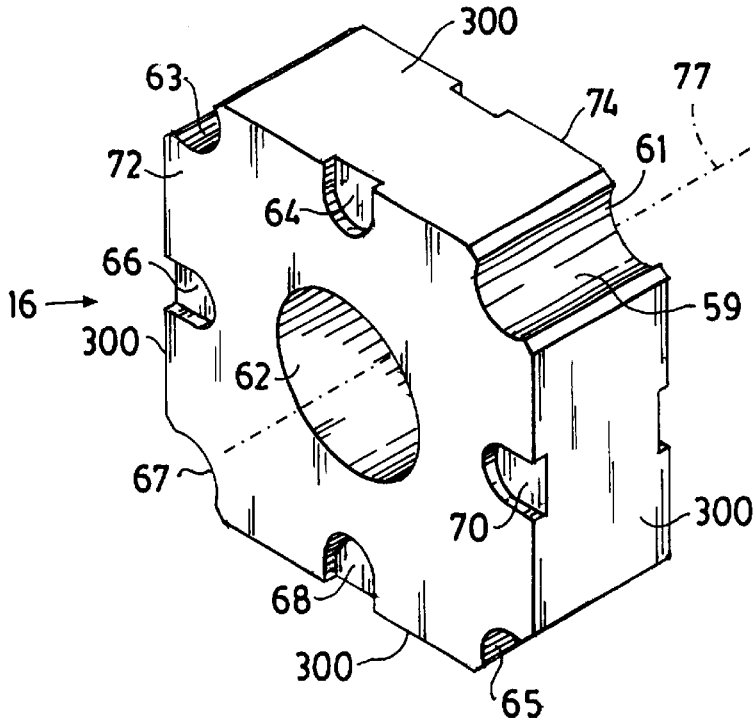
FIG. 5 PRIOR ART
FIG. 5 is a perspective view of the rotor of the device of FIG. 1.
Figure 7:
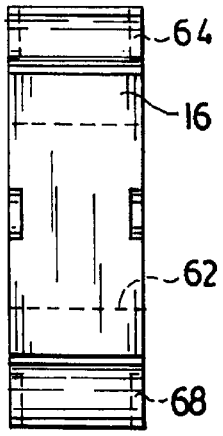
FIG. 7 PRIOR ART
FIG. 7 is a transverse, cross-sectional view of the rotor of FIG. 5.
Figure 6:
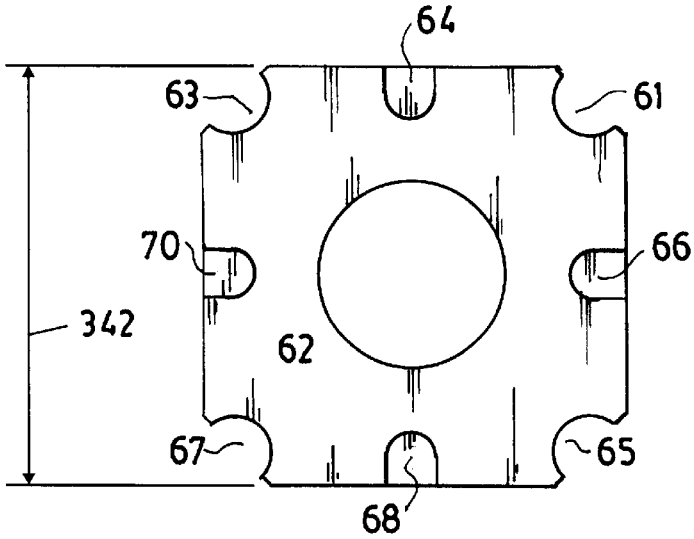
FIG. 6 PRIOR ART
FIG. 6 is an axial, cross-sectional view of the rotor of FIG. 5.
Figure 8:
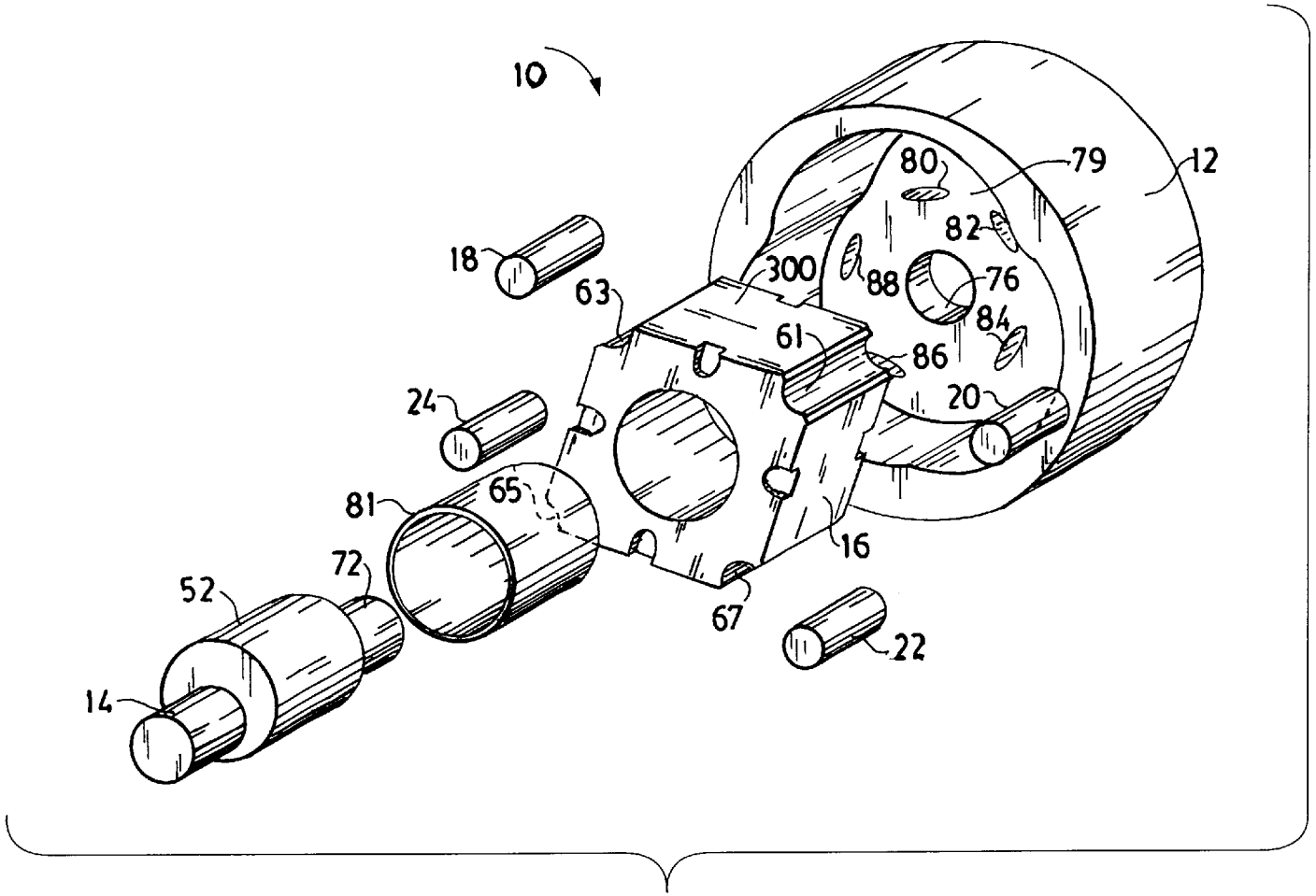
FIG. 8 PRIOR ART
FIG. 8 is an exploded, perspective view of the device of FIG. 1.

Referring to FIG. 5, it will be seen that rotor 300 is comprised of a bore 62 with an axial centerline 77 extending through the geometric center of said bore 62.

Referring to FIGS. 1 through 8, and to the embodiment depicted therein, it will be noted that rollers 18, 20, 22, and 24 (see FIGS. 1 and 8) are solid. In the rotary positive displacement device of one embodiment of the instant invention, however, the rollers used are hollow.

Figure 9:
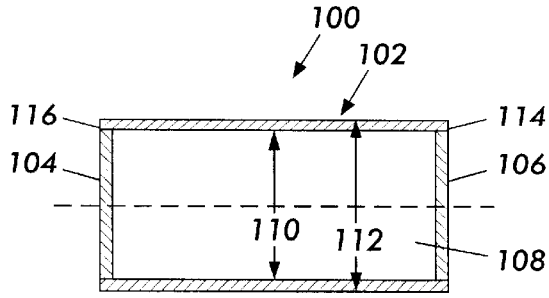
FIG. 9 is a sectional view of one hollow roller which can be used in the rotary positive displacement device of this invention.

FIG. 9 is a sectional view of a hollow roller 100 which may be used to replace the rollers 18, 20, 22, and 24 of the device of FIGS. 1 through 8. In the preferred embodiment depicted, it will be seen that roller 100 is a hollow cylindrical tube 102 with ends 104 and 106.

Tube 102 may consist of metallic and/or non-metallic material, such as aluminum, bronze, polyethyletherketone, reinforced plastic, and the like. The hollow portion 104 of tube 102 has a diameter 110 which is at least about 50 percent of the outer diameter 112 of tube 102.

The presence of ends 106 and 104 prevents the passage of gas from a low pressure region (not shown) to a high pressure region (not shown). These ends may be attached to tube 102 by conventional means, such as adhesive means, friction means, fasteners, threading, etc.

In the preferred embodiment depicted, the ends 106 and 104 are aligned with the ends 114 and 116 of tube 102. In another embodiment, either or both of such ends 106 and 104 are not so aligned.

In one embodiment, the ends 106 and 104 consist essentially of the same material from which tube 102 is made. In another embodiment, different materials are present in either or both of ends 106 and, 104 and tube 102.

In one embodiment, one of ends 106 and/or 104 is more resistant to wear than another one of such ends, and/or is more elastic.

Figure 10:
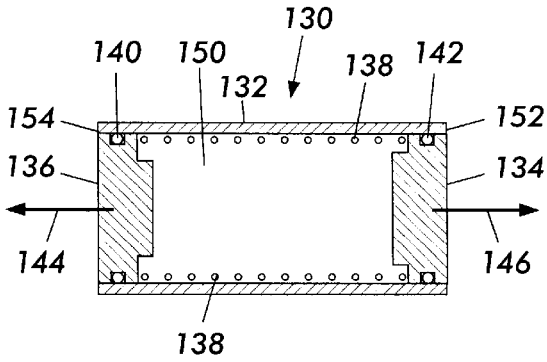
FIG. 10 is a sectional view of another hollow roller which can be used in the rotary positive displacement device of this invention.

FIG. 10 is sectional view of another preferred hollow roller 130, which is comprised of a hollow cylindrical tube 132, end 134, end 136, resilient means 138, and O-rings 140 and 142. In this embodiment, a spring 138 is disposed between and contiguous with ends 134 and 136, urging such ends in the directions of arrows 144 and 146, respectively. It will be appreciated that these spring-loaded ends tend to minimize the clearance between roller 130 and the housing in which it is disposed; and the O-rings 140 and 142 tend to prevent gas and/or liquid from entering the hollow center section 150.

In the preferred embodiment depicted, the ends 134 and 136 are aligned with the ends 152 and 154 of tube 132. In another embodiment, not shown, one or both of ends 144 and/or 146 are not so aligned.

The resilient means 138 may be, e.g., a coil spring, a flat spring, and/or any other suitable resilient biasing means.

Figure 11:
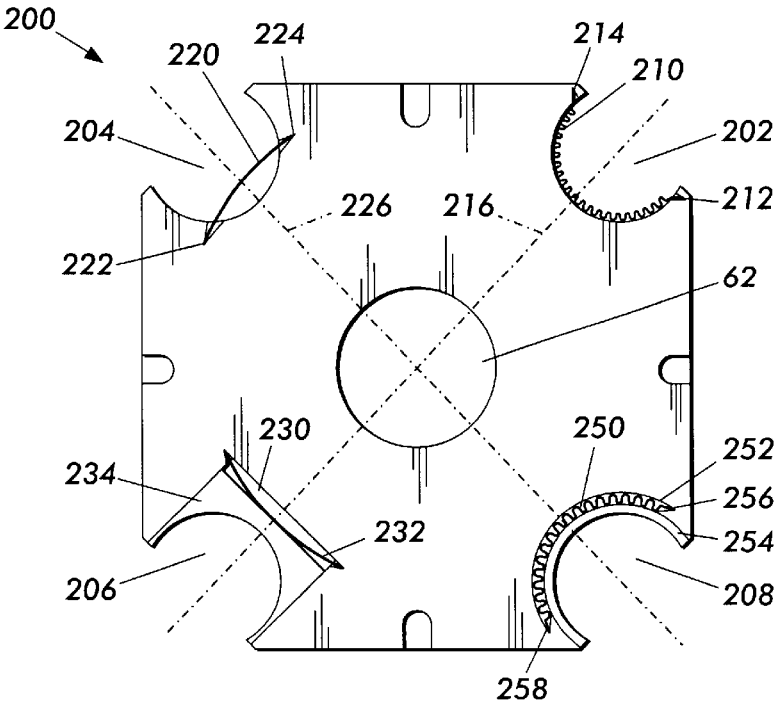
FIG. 11 is at schematic view of a modified rotor which can be used in the positive displacement device of this invention.

FIG. 11 is a schematic view of a rotor 200 which may be used in place of the rotor 16 depicted in FIGS. 1, 5, 6, 7, and 8. Referring to FIG. 11, partial bores 202, 204, 206, and 208 are similar in function, to at least some extent, the partial bores 61, 63, 65, and 67 depicted in FIGS. 5, 6, 7, and 8. Although, in FIG. 11, a different partial bore has been depicted for elements 202, 204, 206, and 208, it still be appreciated that this has been done primarily for the sake of simplicity of representation and that, in most instances, each of partial bores 61, 63, 65, and 67 will be substantially identical to each other.

It will also be appreciated that the partial bores 202, 204, 206, and 208 are adapted to be substantially compliant to the forces and loads exerted upon the rollers (not shown) disposed within said partial bores and, additionally, to exert an outwardly extending force upon each of said rollers (not shown) to reduce the clearances between them and the housing (not shown).

Referring to FIG. 11, partial bore 202 is comprised of a ribbon spring 210 removably attached to rotor 16 at points 212 and 214. Because of such attachment, ribbon spring 210 neither rotates nor slips during use. The ribbon spring 210 may be metallic or non-metallic.

In one embodiment, depicted in FIG. 11, the ribbon spring 210 extends over an are greater than 90 degrees, thereby allowing it to accept loads at points which are far from centerline 216.

Partial bore 204 is comprised of a bent spring 220 which is affixed at ends 222 and 224 and provides substantially the same function as ribbon spring 210. However, because bent spring extends over an are less than 90 degrees, it accepts loads primarily at around centerline 226.

Partial bore 206 is comprised of a cavity 230 in which is disposed bent spring 232 and insert 234 which contains partial bore 206. It Will be apparent that the roller disposed within bore 206 (and also within bores 202 and 204) are trapped by the shape of the bore and, thus, in spite of any outwardly extending resilient forces, cannot be forced out of the partial bore. In another embodiment, not shown, the partial bores 202, 204, 206, and 208 do not extend beyond the point that rollers are entrapped, and thus the rollers are free to partially or completely extend beyond the partial bores.

Referring again to FIG. 11, it will be seen that partial bore 208 is comprised of a ribbon spring 250 which is similar to ribbon spring 210 but has a slightly different shape in that it is disposed within a cavity 252 behind a removable cradle 254. As will be apparent, the spring 250 urges the cradle 254 outwardly along axis 226. Inasmuch as the spring 250 extends more than about 90 degrees, it also allows force vectors near ends 256 and 258, which, in the embodiment depicted, are also attachment points for the spring 250.

Another Rotor Used in the Guided Rotor Compressors

Figure 12:
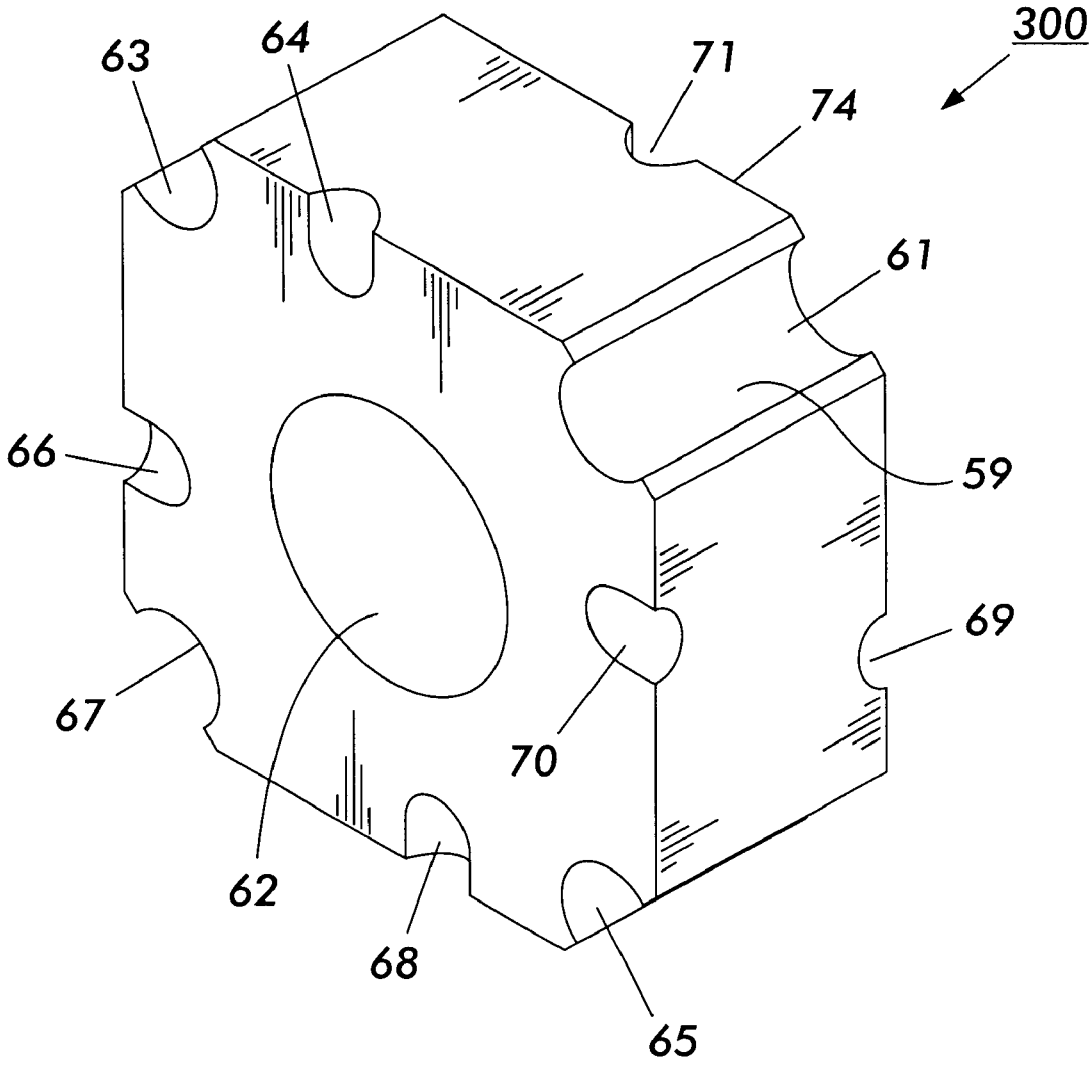
FIG. 12 is perspective view of one preferred rotor of the invention.

FIG. 12 is a perspective view of another rotor 300 which is similar to the rotor 16 depicted in FIG. 5 of the U.S. Pat. No. 5,431,551 but differs therefrom in that the recesses 64, 66, 68, and 70 are not aligned with the opposing recesses (not shown except for recesses 69 and 71) on the back face 74 of rotor 300. Furthermore, and in the embodiment depicted, and unlike the situation with the rotor depicted in FIG. 5 of U.S. Pat. No. 5,431,551, the recesses of the rotor of this invention 64 and 68, and 66 and 70, are not aligned with each other. Similarly, and in the preferred embodiment depicted in FIG. 12, recess 71 and its opposing recess (not shown) of the back side 74 of the rotor, and recess 69 and its opposing recess (not shown) on the back side 74 of the rotor, are not aligned.

Figure 13A:
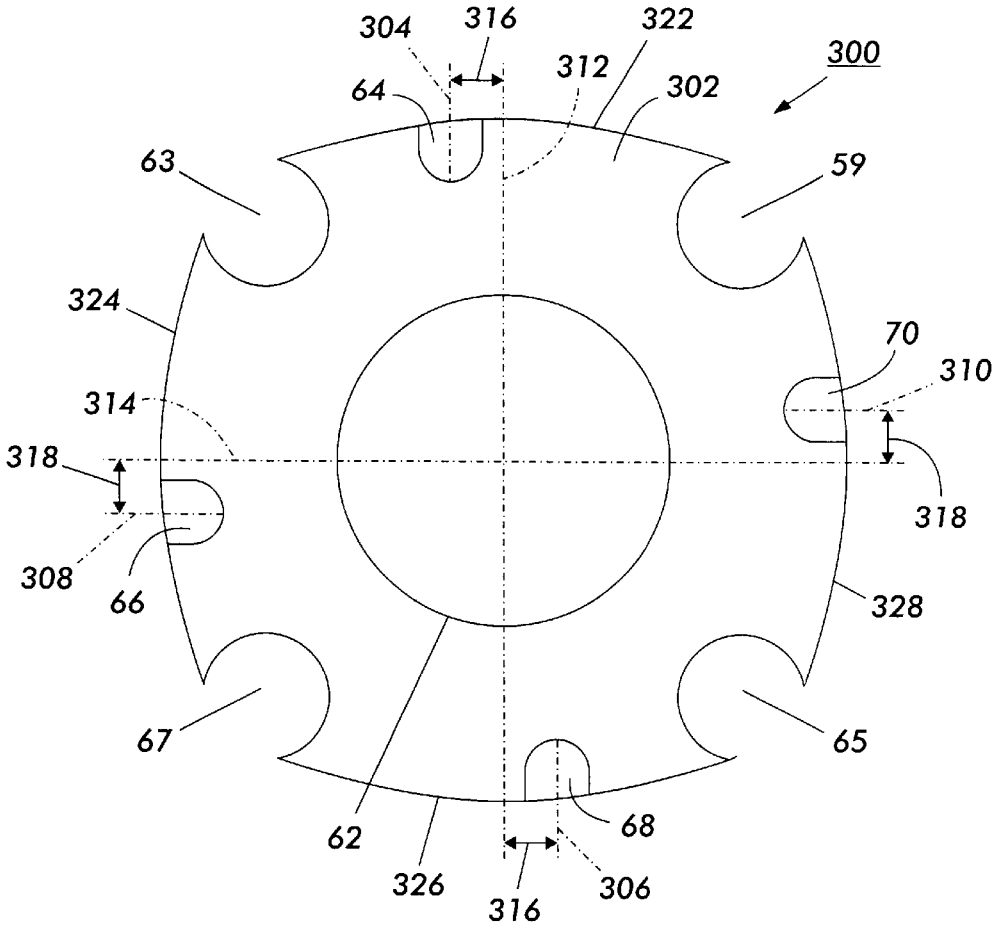
FIGS. 13A and 13B are front and side views of another preferred rotor of the invention.
Figure 13B:
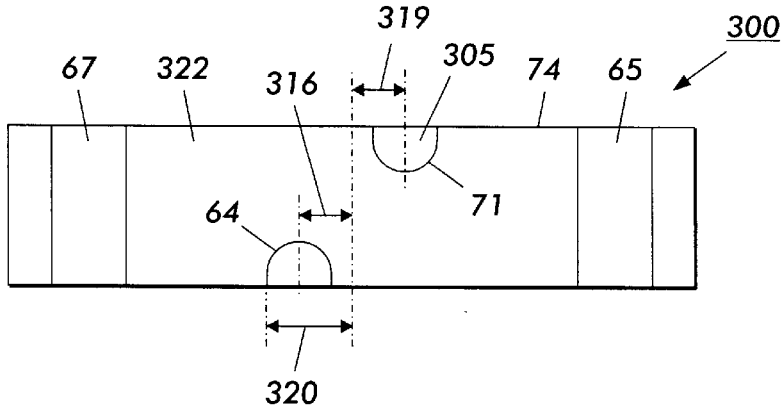

FIG. 13A is a front view of rotor 300, and FIG. 13B is a side view of rotor 300. Referring to FIG. 13A, and to the recesses 64, 66, 68, and 70 depicted therein, it will be apparent to those skilled in the art that these recesses are present in the front face 302 of the rotor 300 and that similar recesses are present on the back face 74 of the rotor (see FIG. 12).

When the word opposing is used in this specification with regard to the recesses 64 et seq., it is meant to convey two recesses which are substantially opposite each other on opposing faces of the 300. Thus, and referring to FIG. 13B, recesses 64 and 71 are not aligned with each other.

Although recesses 64 and 71 are substantially opposed to each other, these recesses are not aligned with each other. Each of the recesses 64 and 71 has a recess centerline defined as the plane bisecting the recess, orthogonally to the face; see centerlines 304, 306, 308, and 310 respectively, which are offset from either the vertical axis 312 and/or the horizontal axis 314 (also known as the transverse centerline 314) of the rotor 300. The offsets are identified as offsets 316 (from the vertical axis 312) and 318 (from the horizontal axis 314).

In the embodiment depicted in FIGS. 13A and 13B, the offset 316 from recess 71 64 is substantially equal to the offset 319 from recess 71. In another embodiment, not shown, the offset 316 differs form the offset 319. In either event, the offset 316, and the offset 319, which may be the same or different, each has a specified finite value which is function of the width 320, * (see FIG. 13B), as measured across the side face surface 322 of the rotor 300. As will be apparent, this width 320 is often the maximum width of the recess 64, 66, 68, or 70, especially in the case of recesses with the oblong configurations shown in FIG. 12.

The offsets 316 and 319, which may be the same or different, are generally greater than 0 and less than 4 times x, provided that the offsets 316 and 319 are at least 0.1 inches. In one embodiment, the offsets 316 and 319 range from about 0.5x to about 3x. In another embodiment, the offsets 316 and 319 range from about 0.5x to about 2.5x.

In the embodiments depicted in the FIGS. 13A and 13B, the recesses 64 and 71 are so configured that their recess center lines 304 and 305 are substantially parallel to the center axis 312 of the rotor 300. In another embodiment, not shown, the recess center lines are not necessarily parallel to the transverse centerlines 312/314 of the rotor. In this latter embodiment, the recess centerlines may intersect axes 312 or 314 to form an acute angle of from about 3 to 60 degrees. In either embodiment, the calculated offset 316/318 is measured from the axis 312 and/or axis 314 to the centerpoint of the recess in question. The centerpoint is defined as the intersection of the recess centerline and the arcuate surface Referring again to FIG. 13A, and in the preferred embodiment depicted therein, it will be seen that rotor 300 is comprised of arcuate walls 322, 324, 326, and 328. In the preferred embodiment depicted, each of these arcuate walls is comprised of a continous arcuate section defined by a constant radius; and each of these arcuate walls defines a convex shape. In this embodiment, the rotor 300 is comprised of four walls 322 et seq.

Figure 14A:
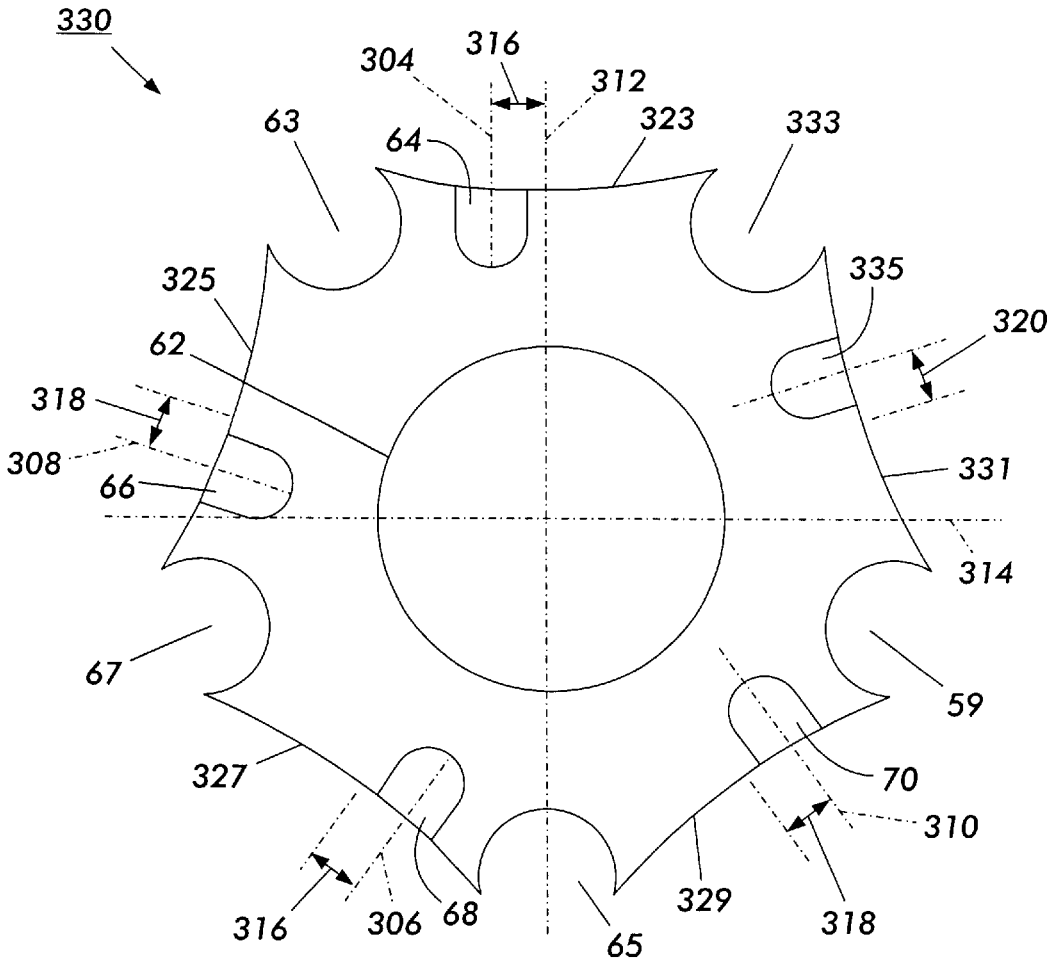
FIGS. 14A and 14B are front and side views of another preferred rotor of the invention.

In another embodiment, depicted in FIGS. 14A and, 14B the rotor 330 is comprised of constant radius arcuate walls, 323, 325, 327, 329, and 331 each of which has a continuous, concave arcuate shape. FIG. 14A is a front view of rotor 330, and FIG. 14B is a side view of rotor 330, taken form the top of said rotor 330.

Figure 14B:
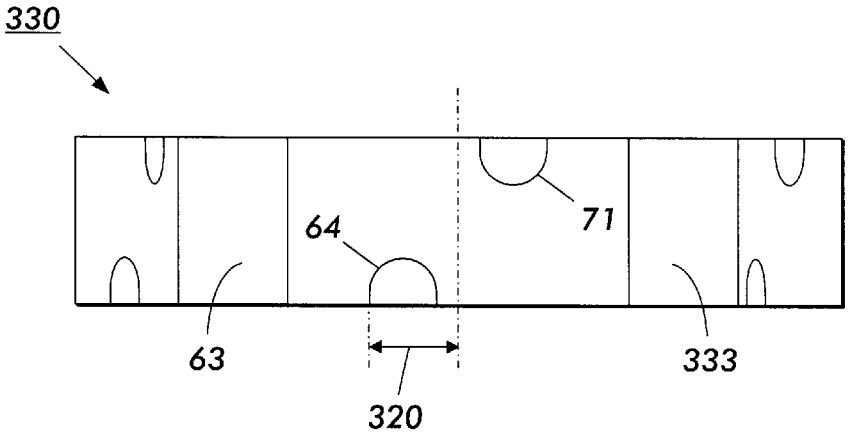

Referring to FIGS. 14A and 14B, the assembly depicted differs form the assembly depicted in FIGS. 13A and 13B in that the former assembly: (a) is comprised of five sides, including side 323, 325, 327, 329, and 331, which are substantially concave in shape and defined by a constant radius, (b) also includes partial roller bore 333, necessitated because it contains five sides rather than four sides, and (c) also includes recess 335, necessitated because it contains five sides rather than four sides. In the embodiment depicted in FIGS. 14A and 14B, because there is an odd number of sides in the rotor assembly 330, no one recess is substantially opposed to any other recess. However, the extent of the offsets form each recess is still calculated in accordance with the range Y is equal to 0.x to about 4.x, wherein Y is the offset and is at least 0.1 inches, and x is the width of the opening.

In this embodiment, because there are an odd number of sides in the assembly, the transverse centerlines of the rotor 330 are not necessarily parallel to recess centerlines.

Figure 15:
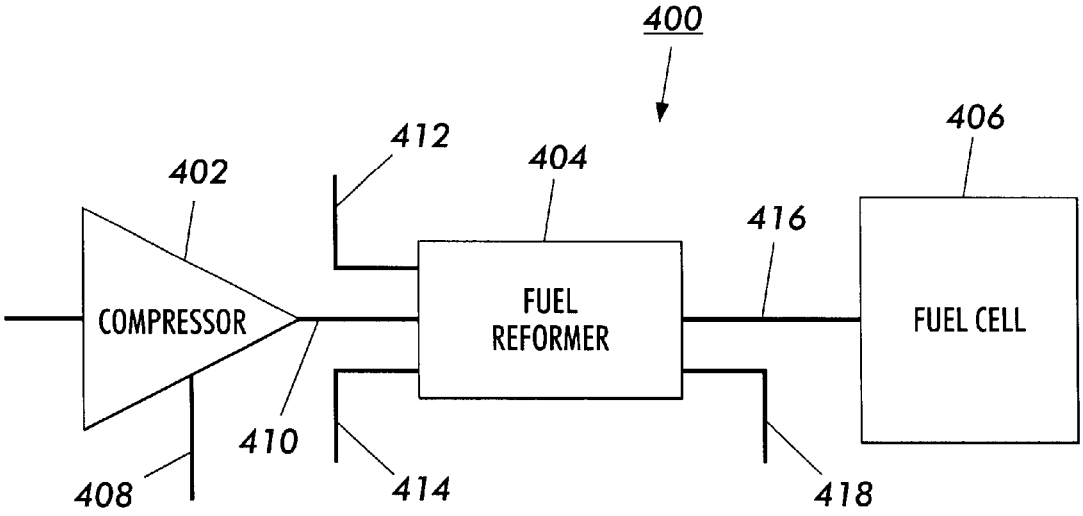
FIG. 15 is a schematic vie of a preferred fuel processor assembly.

FIG. 15 is a flow diagram of a preferred fuel cell assembly 400, comprised of a guided rotor compressor 402, a fuel reformer 404, and a fuel cell 406.

The guided rotor compressor 402 may be any one of the guided rotor compressors described in U.S. Pat. No. 5,431,551 in U.S. Pat. No. 6,301,898, and/or in this specification. It is preferred that the bearing system 81 of such compressor (not shown in FIG. 15, but see FIG. 8) be a graphite bearing. Reference may be had, e.g., to U.S. Pat. Nos. 3,721,479, 5,017,022, 4,867,006, 4,880,326, 4,798,771, 4,545,337, and the like. The entire disclosure of each of these United States patents is hereby incorporated by reference into this specification.

The bearing system 81 is preferably a water-lubricated carbon bearing system. Thus, and referring again to FIG. 15, water is introduced into compressor 402 via line 408. In this embodiment, it is preferred to introduce water at a temperature of less than about 120 degrees. Fahrenheit and at a pressure less than about 500 pounds per square inch gauge.

The compressor 402 is preferably made from corrosion resistant material. Thus, e.g., in one embodiment, the compressor 402 is made from either stainless steel and/or a material which is coated to prevent corrosion. Such corrosion resistant coatings are well known to those skilled in the art. Reference may be had, e.g., to U.S. Pat. Nos. 4,479,981, 5,691,048, 5,707,465, 4,866,116, 5,807,430, and the like. The entire disclosure of each of these United States patents is hereby incorporated by reference into this specification.

Referring again to FIG. 15, the compressor 402 feeds compressed gas via line 410 to fuel reformer 404. In one embodiment, the gas fed via line 410 is natural gas at a pressure of from about 5 to about 500 pounds per square inch gauge.

In the embodiment depicted in FIG. 15, steam may optionally be fed to fuel reformer 404 via line 412, and air may be fed to fuel reformer 404 via line 414. In another embodiment, steam is fed form compressor 402 via line 410 to fuel reformer 404.

One may use any of the fuel reformers known to those skilled in the art. Reference may be had, e.g., to U.S. Pat. Nos. 6,301,898, 5,141,824, 4,923,868, 5,637,414, 5,484,577, 4,642,273, 5,268,240, and the like. The entire disclosure of each of these United States patents is hereby incorporated by reference into this specification.

Flowing from the reformer 4044 will be hydrogen (within line 416), and waste gas (fed to external receptacle or use via line 418). The hydrogen, which is preferably substantially pure, is fed to the fuel cell 406, wherein it is converted to electricity.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A rotary positive displacement compressor assembly comprising a housing having a curved inner surface with a profile equidistant from a trochoidal curve, an eccentric mounted on a shaft disposed within said housing, a rotor mounted said eccentric shaft which comprised of a bore with an axial centerline, a front face, aback face, a first side, a second side, and a third side, a first partial bore disposed at the intersection of the first side and the second side, a second partial bore disposed at the intersection of said second side and said third side, a third partial bore disposed at the intersection of said third side and said first side, a first roller disposed and rotatably mounted within said first partial bore, and a third roller disposed and rotatably mounted within said third partial bore, wherein:

(a) a first opening is formed between and communicates between said front face and said first side, a second opening is formed between and communicates between said back face and said first side, a third opening is formed between and communicates between said front face and said second side, a fourth opening is formed between and communicates between said back face and said second side, fifth opening is formed between and communicates between said front face and said third side, and a sixth opening is formed between and communicates between said back face and said third side; and (b) a first transverse rotor centerline extends through said first side, a second transverse rotor centerline extends through said second side, and a third transverse rotor centerline extends through said third side, provided that each of said first transverse rotor centerline, said second transverse rotor centerline, and said third transverse rotor centerline also extends through said axial centerline said rotor; and (c) said first opening is comprised of a first opening centerline, said second opening is comprised of a second opening centerline, provided that the first opening centerline and said second opening centerline are each offset from said first transverse rotor centerline by at least 0.1 inches and from about 0.x to about 4.x, wherein x is equal to the width of said first opening and said second opening, respectively; and (d) said third opening is comprised of a third opening centerline, said fourth opening is comprised of a fourth opening centerline, provided that said third opening centerline and said fourth opening centerline are each offset from said third transverse rotor centerline by at least 0.1 inches and from about 0.x to about 4.x, wherein x is equal to the width of said third opening and said fourth opening, respectively; and (e) said fifth opening is comprised of a fifth opening centerline, said sixth opening is comprised of a sixth opening centerline, provided that said fifth opening centerline and said sixth opening centerline are each offset from said third transverse rotor centerline by at least 0.1 inches and from about 0.x to about 4.x, wherein x is equal to the width of said fifth opening and said sixth opening, respectively; and wherein a degree to which said first opening centerline, said third opening centerline, and said fifth opening centerline are offset from said rotor transverse centerlines are the same; and wherein a degree to which said second opening centerline, said fourth opening centerline, and said sixth opening centerline are offset respectively, from said first rotor transverse centerline, said second rotor transverse centerline, and said third rotor transverse centerline, are the same.

2. The compressor assembly as recited in claim 1, wherein each of said first roller, and said third roller is a hollow roller.

3. The compressor assembly as recited in claim 1, wherein each of said first roller, said second roller, and said third roller is a solid roller.

4. The compressor assembly as recited in claim 1, wherein said compressor is a fluid-lubricated compressor.

5. The compressor assembly as recited in claim 4, wherein said fluid is air.

6. The compressor assembly as recited in claim 4, wherein said fluid is a liquid.

7. The compressor assembly as recited in claim 6, wherein said liquid is oil.

8. The compressor assembly as recited in claim 6, wherein said liquid is water.

9. The compressor assembly as recited in claim 6, wherein said liquid is ethylene glycol.

10. The compressor assembly as recited in claim 8, wherein said compressor assembly further comprises means for feeding water to said compressor assembly.

11. The compressor assembly as recited in claim 10, wherein said compressor assembly is comprised of a bearing system.

12. The compressor assembly as recited in claim 11, wherein said bearing system is a graphite bearing system.

13. The compressor assembly as recited in claim 12, wherein said compressor assembly is comprised of corrosion resistant material.

14. The compressor assembly as recited in claim 13, wherein said compressor assembly is comprised of stainless steel.

15. The compressor assembly as recited in claim 14, wherein said compressor assembly is further comprised of a fuel reformer.

16. The compressor assembly as recited in claim 1, wherein said first side is comprised of a first constant radius arcuate section, said second side is comprised of a second constant radius arcuate section, and said third side is comprised of a third constant radius arcuate section.

17. The compressor assembly as recited in claim 16, wherein each of said first constant radius arcuate section, said second constant radius arcuate section, and said third constant radius arcuate section has a convex shape.

18. The compressor assembly as recited in claim 16, wherein each of said first constant radius arcuate section, said second constant radius arcuate section, and said third constant radius arcuate section has a concave shape.

* * * * *